United States Patent [19]

Burton

[11] 4,299,151

[45] Nov. 10, 1981

[54] CUTTING MECHANISM FOR A PACKAGING MACHINE

[75] Inventor: Charles A. Burton, Columbus, Ohio

[73] Assignee: Rexham Corporation, New York, N.Y.

[21] Appl. No.: 133,473

[22] Filed: Mar. 24, 1980

[51] Int. Cl.[3] ..... B26D 1/60

[52] U.S. Cl. ..... 83/300; 83/320; 83/328

[58] Field of Search ..... 83/320, 318, 328, 317, 83/300, 49, 52, 43, 683, 315, 316, 327; 53/455

[56] References Cited

U.S. PATENT DOCUMENTS

| | | | |
|---|---|---|---|
| 951,840 | 3/1910 | Peterson | 83/320 |
| 2,172,988 | 9/1939 | Pohndorf et al. | 83/52 X |
| 2,228,162 | 1/1941 | Benham et al. | 83/300 |
| 2,649,673 | 8/1953 | Bartelt | 53/86 |
| 2,673,431 | 3/1954 | Harker | 53/89 |
| 2,857,966 | 10/1958 | Sarka | 83/315 X |
| 3,230,687 | 1/1966 | Nutting et al. | 53/180 |
| 3,244,048 | 4/1966 | Salger | 83/320 X |
| 3,264,920 | 8/1966 | Hallden | 83/328 X |
| 4,056,994 | 11/1977 | Ihle | 83/328 X |
| 4,196,645 | 4/1980 | Shimizu et al. | 83/320 X |

*Primary Examiner*—Frank T. Yost

*Attorney, Agent, or Firm*—Leydig, Voit, Osann, Mayer & Holt, Ltd.

[57] ABSTRACT

Upright pouches are successively severed from the leading end portion of a continuously advancing strip of interconnected pouches by a pair of coacting blades which track the strip and which momentarily move at the same speed as the strip. At that time, one blade is shifted laterally toward the other blade to cut the leading pouch from the strip. Prior to the cutting, a notch is formed in the upper edge portion of the strip between adjacent pouches to impart a desired shape to the upper corners of the pouches and to enable the use of a relatively simple stationary splitter for keeping the two upper edge portions of each pouch separated from one another.

9 Claims, 15 Drawing Figures

CUTTING MECHANISM FOR A PACKAGING MACHINE

BACKGROUND OF THE INVENTION

This invention relates to a packaging machine of the type in which a strip of interconnected, open-ended pouches is advanced edgewise along a predetermined path to a cutting station where successive pouches are periodically severed from the leading end portion of the strip. The pouch strip usually is defined by a pair of face-to-face panels made of flexible material and sealed together by longitudinally spaced and vertically extending heat seals which terminate short of the upper edges of the panels. Severing of the pouches from the strip is effected by a cutter having a pair of coacting blades disposed on opposite sides of the strip and operable to cut through the heat seals.

To facilitate handling of the pouches after cut-off, it is desirable to keep the upper edge portions of the panels of the strip separated from one another before, during and after the time the pouches are severed from the strip. Such separation typically is achieved through the use of an elongated splitter bar which projects downwardly between the upper edge portions of the panels. With prior machines, it has been necessary either to completely interrupt the splitter bar at the cutting station or to provide some type of movable splitter at the cutting station in order to avoid interference between the splitter and the cutting blades when the blades cut through the pouch strip. A packaging machine with an interrupted splitter is disclosed in Bartelt U.S. Pat. No. 2,649,673. Machines with movable splitters are disclosed in Harker U.S. Pat. No. 2,673,431 and Nutting et al U.S. Pat. No. 3,230,687.

The invention has more particular reference to a packaging machine in which the pouch strip is advanced with continuous motion rather than with intermittent or start-stop motion. In such a machine, cutting of the pouches takes place while the strip is moving and thus it is necessary for the cutter to operate in a continuous manner so that the blades will not interfere with the advance of the strip when the blades cut through the strip. The aforementioned Nutting et al patent discloses a packaging machine having a continuous motion cutter.

SUMMARY OF THE INVENTION

One of the aims of the present invention is to provide a new and improved packaging machine in which a relatively simple stationary splitter keeps the upper edge portions of the panels of the pouch strip separated even where the strip is being cut, the stationary splitter eliminating the need for complex movable splitters and, at the same time, enabling the panels to be kept separated in a more positive and controllable manner than has been possible heretofore.

A more detailed object is to achieve the foregoing through the provision of a packaging machine which uniquely notches the upper end portion of the strip prior to cutting through the strip, the notching forming the pouches with a desirable shape and avoiding the need for either interrupting or moving the splitter at the main cutting station.

A further object of the invention is to provide a packaging machine having a novel continuous motion cutter which is capable of operating at higher speeds and with a more positive cutting action than prior cutters.

Another object is to provide a continuous motion cutter in which two coacting blades longitudinally track the pouch strip and in which one blade moves laterally of the other to cut the strip. The cutter is particularly characterized by the manner in which the blades are moved in order to effect positive and high speed cutting of the strip.

Still another object of the invention is to provide a continuous motion cutter whose drive can be adjusted in a relatively easy manner to enable the packaging machine to handle pouches of different widths.

The invention also resides in the unique coaction between the cutter and a notching punch and die for notching the upper end of the pouches.

These and other objects and advantages of the invention will become more apparent from the following detailed description when taken in conjunction with the accompanying drawings.

Figure 1:
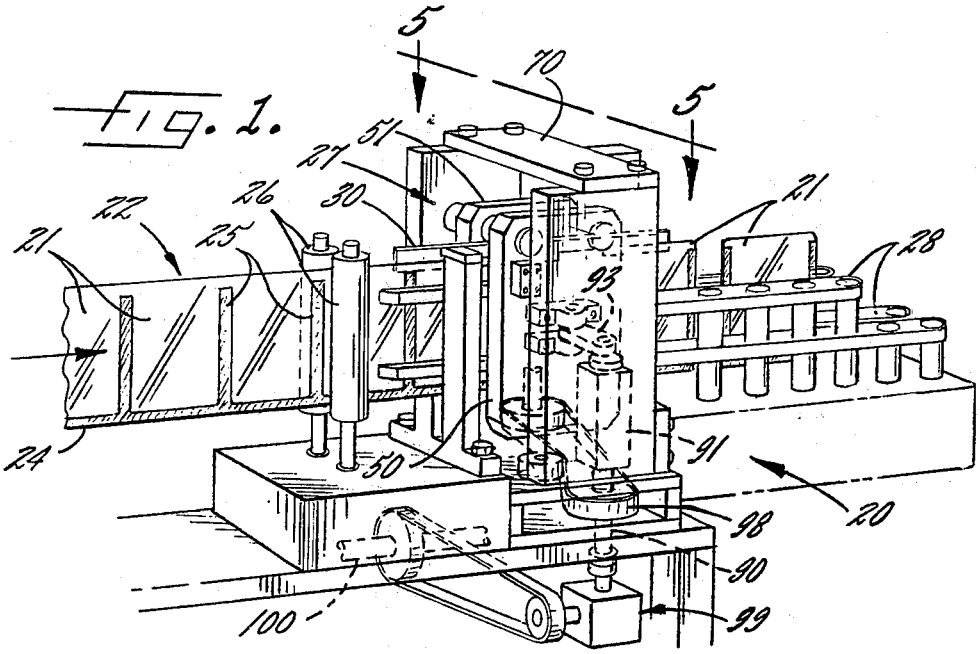
FIG. 1 is a fragmentary perspective view of a new and improved packaging machine incorporating the unique features of the present invention.

FIGS. **12*a* through 12*d*** are schematic top plan views which show successive positions of certain parts of the cutting mechanism.

DETAILED DESCRIPTION OF THE PREFERRED EMBODIMENT

As shown in the drawings for purposes of illustration, the invention is embodied in an automatic packaging machine 20 of the type in which pouches 21 are periodically severed from the leading end portion of a continuously advancing strip 22 of pouches, are filled with product, and then are sealed at their tops. The pouch filling and top sealing mechanisms do not form part of the present invention and thus will not be described herein.

The pouch strip 22 is formed by folding a horizontal web of flexible material upwardly about its longitudinal centerline as the web is advanced beneath a plow (not shown). The folding causes the web to be formed into two face-to-face panels which are disposed in upright planes and which are joined by a bottom fold. A continuous heat seal 24 (FIG. 2) subsequently is formed along the bottom fold. In addition, the two panels are sealed together by longitudinally spaced and vertically extending heat seals 25 which terminate a short distance below the upper edges of the panels. Thus, the web of material is converted into a strip 22 of interconnected pouches 21 having open upper ends.

Disposed on opposite sides of the strip 22 are two power-rotated feed rolls 26 (FIG. 1) which act to pull the strip continuously along a predetermined path. After the pouches 21 pass by the feed rolls, they move into a cutting station 27. At the cutting station, each side seal 25 is cut midway between its side edges so that successive pouches are severed from the leading end portion of the strip. Each severed pouch is advanced out of the cutting station by a set of accelerator belts 28 and then is picked up by a transfer mechanism (not shown) for delivery to the pouch filling section of the packaging machine 20. The accelerator belts and the pouch transfer mechanism are disclosed in detail in Russell et al United States application Ser. No. 119,366, filed Feb. 7, 1980, entitled Packaging Machine With Pouch Opening And Transfer Mechanism and assigned to the assignee of the present invention.

To keep the tops of the pouches 21 open and facilitate handling of the pouches by the transfer mechanism, a splitter bar 30 overlies the strip 22 and projects downwardly between the two side panels thereof to hold the upper edge portions of the side panels separated from one another. Herein, the splitter 30 is in the form of a thin, elongated blade which is disposed in a vertical plane. The splitter extends from a location upstream of the cutting station 27 to a location downstream of the cutting station.

In accordance with one aspect of the present invention, the strip 22 is cut in a unique manner which enables the splitter 30 to remain between the upper edge portions of the side panels of the strip even when the strip is being advanced through and cut at the cutting station 27. As a result, the splitter may be of comparatively simple construction and yet is capable of maintaining better separation of the upper edge portions of the strip and the pouches 21 than has been the case with prior splitters.

Figure 3:
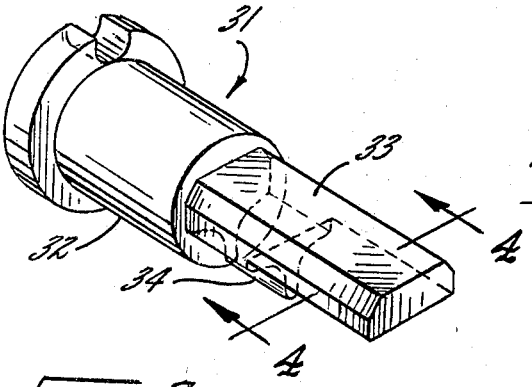
FIG. 3 is a perspective view of the notching punch.
Figure 4:
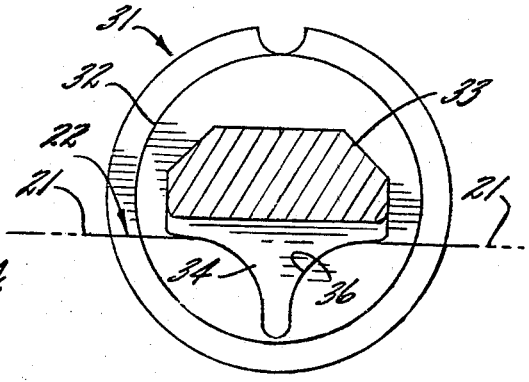
FIG. 4 is an enlarged cross-section taken along the line 4—4 of FIG. 3.
Figure 7:
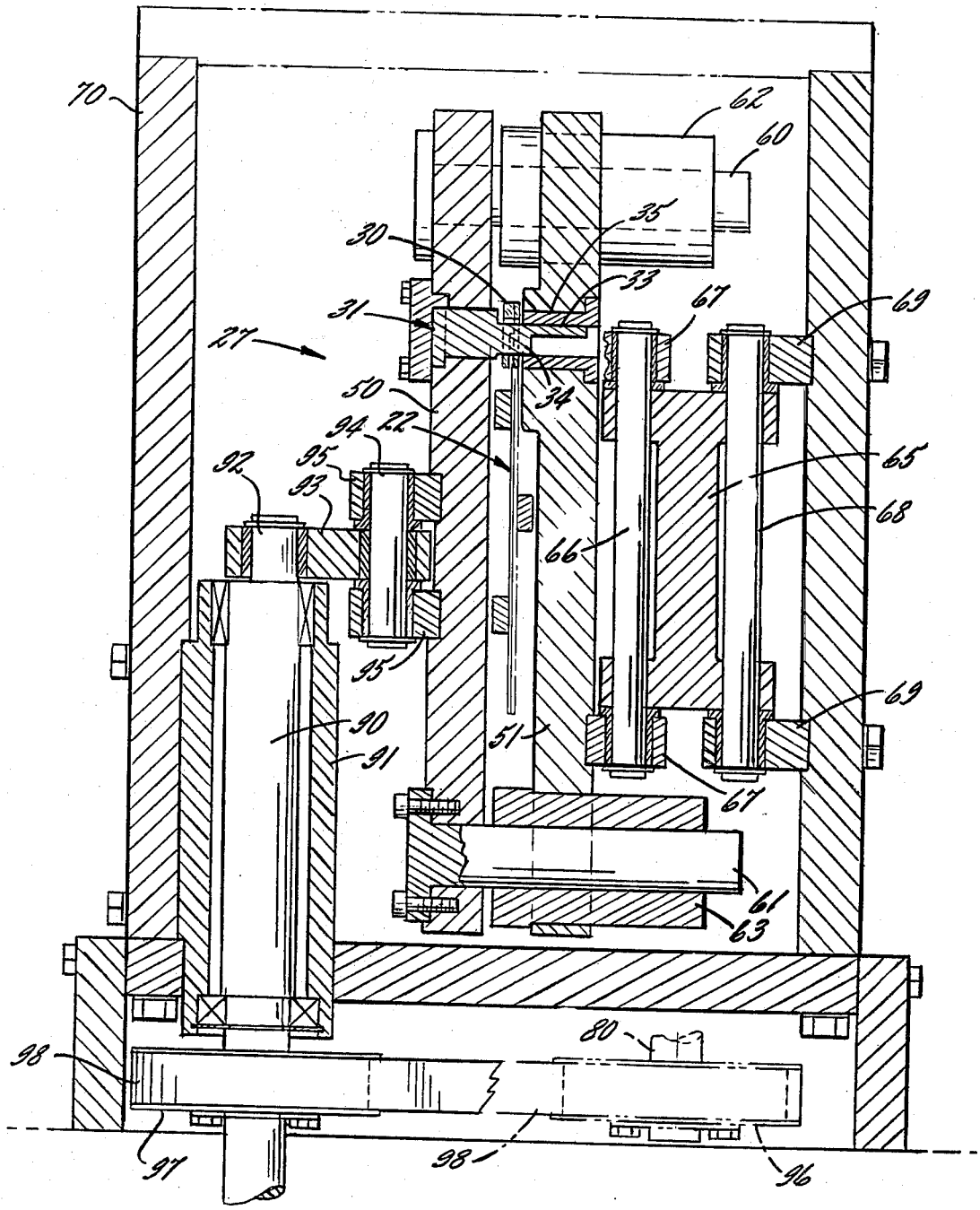

The foregoing is achieved by making two successive cuts in the strip 22 at each longitudinal position corresponding to the longitudinal position of a side seal 25. The first cut is formed above the upper end of the side seal and adjacent the upper edges of the strip and is made by a notching punch 31 (FIGS. 3 and 4) which is adapted to reciprocate laterally of the strip. The punch includes a body 32, a projecting guide 33, and a generally V-shaped punching element 34 whose outer sides are concavely curved. Disposed on the opposite side of the strip from the punch is a notching die 35 (FIG. 5) having a cavity whose shape is complementary to that of the guide 33 and the punching element 34. When the punch 31 is shifted laterally toward the strip 22, the punching element 34 enters into the cavity of the die 35 and notches the upper edge portion of the strip. The punch then is retracted laterally away from the strip to pull the punching element out of the die cavity and avoid interference with the advance of the strip. The guide 33 is located above the upper edge of the strip and always remains telescoped in the die cavity during lateral reciprocation of the punch (see FIG. 7). The guide 33 slides back and forth in the die cavity to keep the punch alined precisely with the die and, during such sliding, the upper edge of the strip 22 moves longitudinally beneath the guide.

By virtue of the shape of the punching element 34, a substantially V-shaped notch 36 (FIG. 4) with convexly curved sides is formed between the upper end portions of adjacent pouches 21. The notch 36 serves two purposes. First, the notch causes the upper corners of each pouch 21 to be formed on a gradual radius rather than being sharp and right angular and thus a desirable shape is imparted to the pouch. Secondly, the notch forms a preliminary cut in the upper end portion of the strip 22 so as to avoid the need of subsequently cutting through such upper portion in order to separate the leading pouch from the strip.

Figure 10:
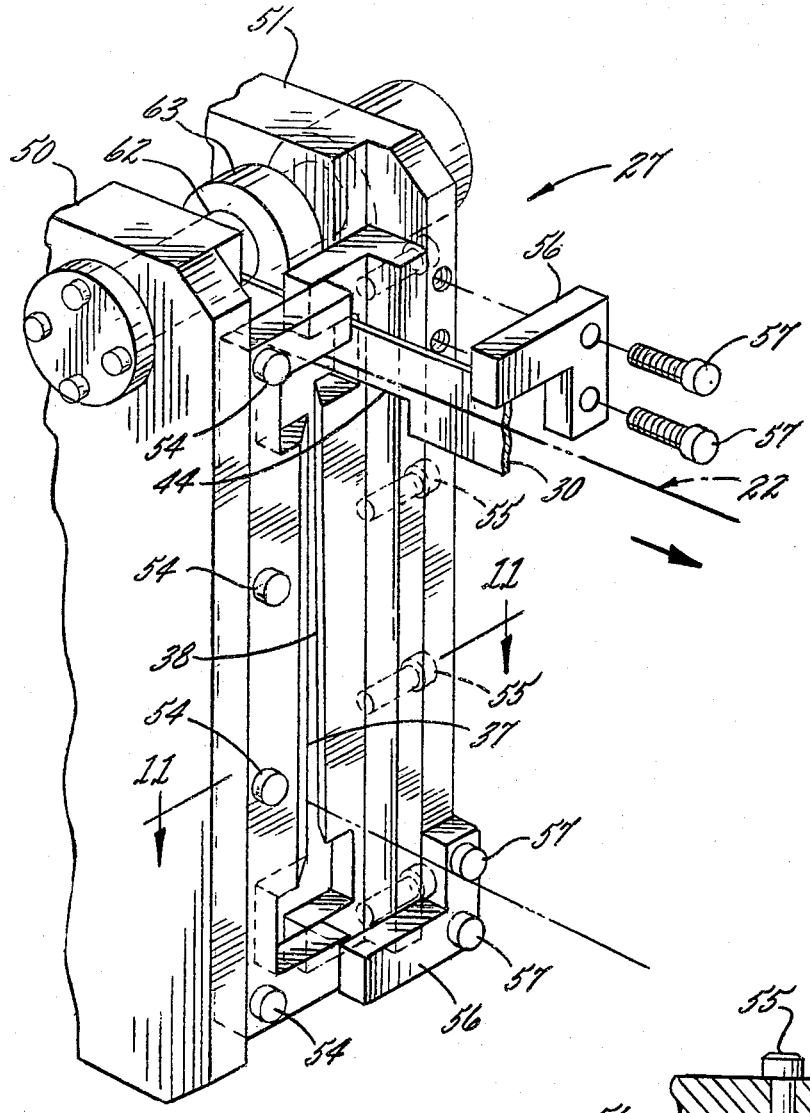
FIG. 10 is an exploded perspective view of part of the cutting mechanism.
Figure 11:
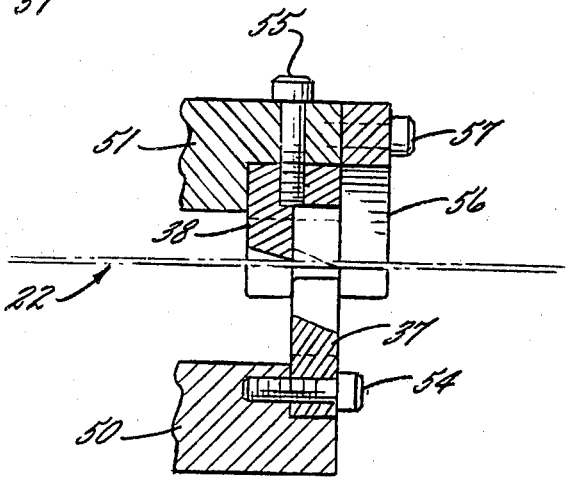
FIG. 11 is a fragmentary cross-section taken substantially along the line 11—11 of FIG. 10.

The second cut in the strip 22 is formed by a pair of substantially vertical blades 37 and 38 (FIGS. 2, 10 and 11) which are located on opposite sides of the strip at a position which is spaced downstream of the punch 31 and the die 35 by a distance which is equal to the width of one pouch 21. The blades extend from a level below the bottom of the strip to a level above the upper ends of the side seals 25 and just very slightly above the lower portion of the punching element 34 of the notching punch 31. The blade 37 is adapted to be shifted laterally toward the blade 38 and, when so shifted, the blade 37 cuts midway along each side seal and cuts through the entire height of the strip except for the notch 36. Accordingly, the blade 37 severs the leading pouch 21 from the strip 22 after the notch 36 has first been formed between that pouch and the adjacent trailing pouch.

Figure 2:
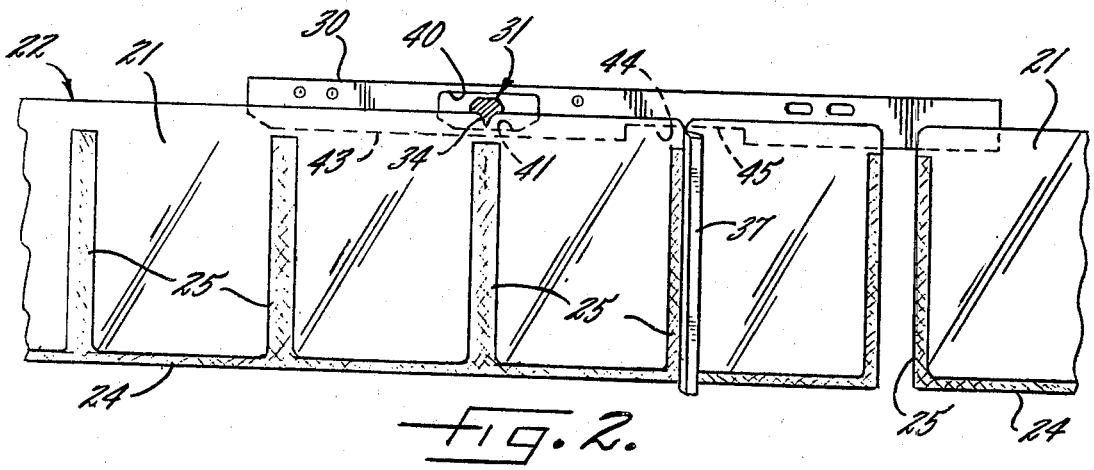
FIG. 2 is an enlarged elevational view of part of the machine shown in FIG. 1.

In carrying out the invention, the notching punch 31 reciprocates laterally through an opening or window 40 (FIG. 2) which is formed through the splitter 30. As shown in FIG. 2, the lower wall 41 of the window 40 is located below the punching element 34 but is located above the lower edge 43 of the splitter. As a result, the punch 31 can move through the window 40 and yet, at the same time, the splitter 30 remains uninterrupted below the window. Accordingly, an uninterrupted portion of the splitter remains between the panels of the strip 22 and keeps the panels separated as the strip is cut by the notching punch.

Further in carrying out the invention, the blade 37 reciprocates laterally through a downwardly opening notch 44 (FIG. 2) which is formed through the lower edge portion of the splitter 30. The upper wall 45 of the notch 44 is located above the upper end of the blade 37 and above the upper wall 41 of the window 40 but is located below the upper edges of the panels of the strip 22. Accordingly, the upper end portion of the blade 37 can move through the notch 44 and can extend into the lower portion of the notch 36 formed by the punch 31 so as to completely sever the pouch 21 from the strip 22. Above the notch 44, however, a portion of the splitter 30 remains between the panels of the strip and keeps the panels separated.

From the foregoing, it will be apparent that some portion of the splitter 30 remains between the panels of the strip 22 throughout the entire length of the splitter and that the panels never move out of straddling relationship with the splitter even when the strip is being cut at the side seals 25. Thus, it is possible to always maintain positive control over the strip. This is achieved by forming a preliminary cut in the strip by means of a first cutter in the form of the notching punch 31 and the notching die 35 and by forming a final cut in the strip by means of a second cutter in the form of the two blades 37 and 38. The punch 31 reciprocates through the window 40 while the blade 37 reciprocates through the notch 44 and, as a result, some portion of the splitter 30 may remain between the panels of the strip 22 both in the area of the punch 31 and in the area of the blade 37.

Figure 5:
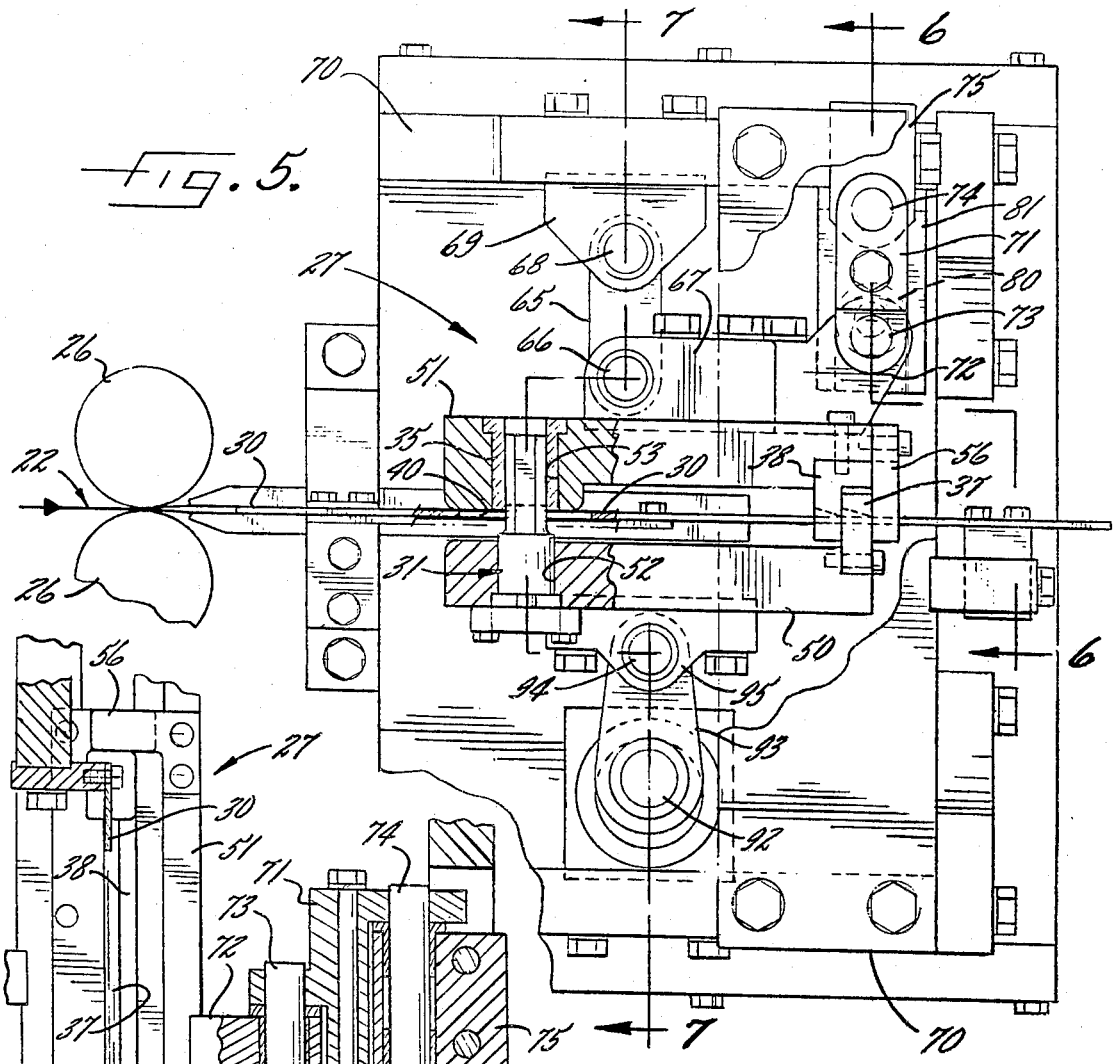
FIG. 5 is an enlarged fragmentary top plan view as taken along the line 5—5 of FIG. 1, certain parts being broken away as shown in section.
Figure 8:
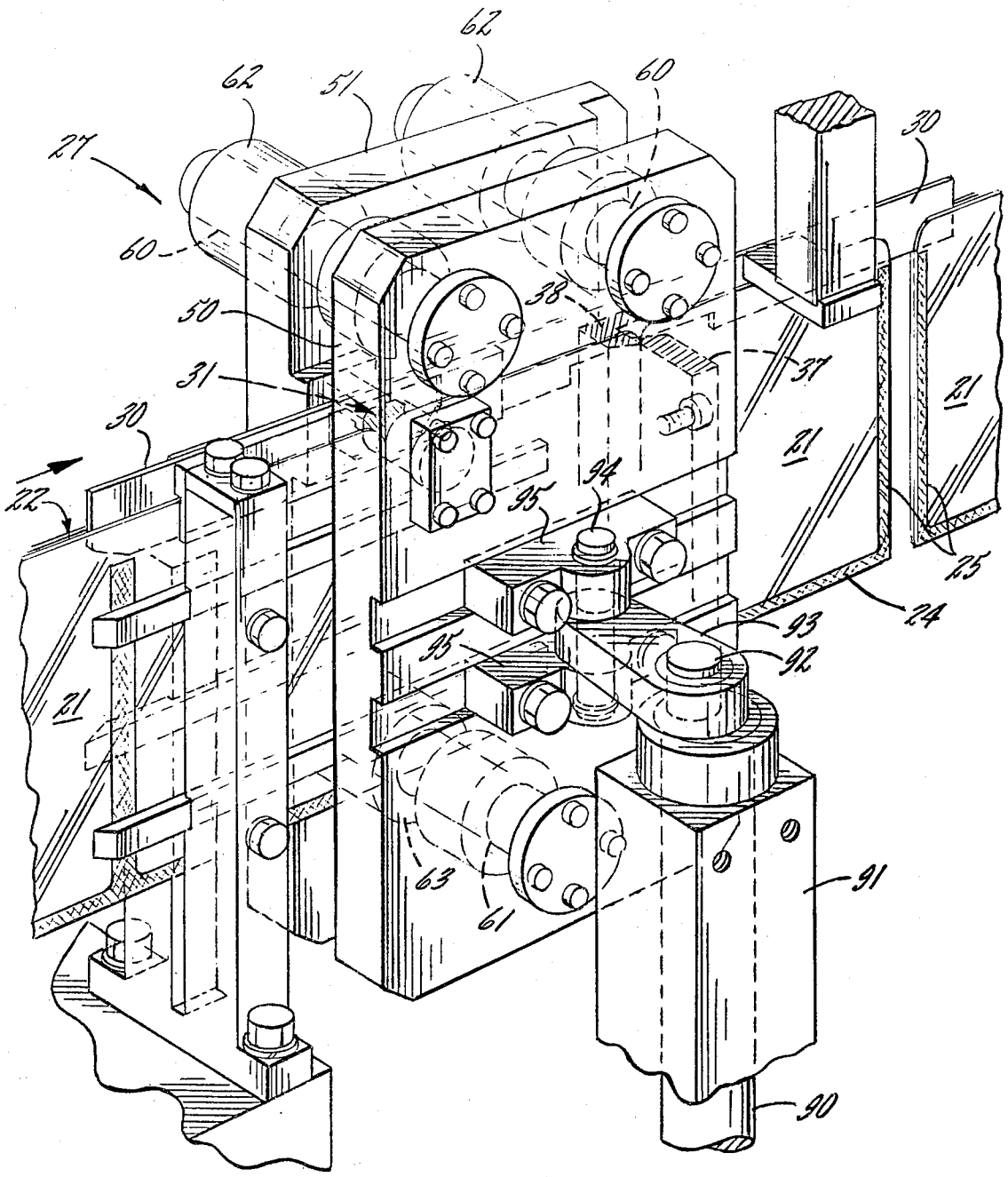
FIG. 8 is a fragmentary perspective view showing the front side of the cutting mechanism.

The notching punch 31 and the blade 37 are mounted on a front carriage 50 (FIGS. 5, 7 and 8) while the notching die 35 and the blade 38 are mounted on a rear carriage 51. The two carriages are located on opposite sides of the strip 22 and each is in the form of an upright platen. As shown in FIG. 5, the punch 31 is secured within a hole 52 in the front platen 50 while the die 35 is secured within a hole 53 in the rear platen 51. The blade 37 is secured to the downstream end of the front platen 50 by screws 54 (see FIGS. 10 and 11) and is located just downstream of the blade 38. Screws 55 fasten the blade 38 to the rear platen 51. The two blades 37 and 38 have sharpened cutting edges which coact with one another to cut the strip 22 with a shearing action when the blade 37 is shifted laterally toward the blade 38. Generally L-shaped guides 56 (FIG. 10) are secured by screws 57 to the downstream end of the rear platen 51 adjacent the upper and lower sides thereof and slidably engage the upper and lower ends of the blade 37 to keep that blade in alinement with the blade 38. The guides 56 are located above and below the strip 22 and thus do not interfere with the advance of the strip.

In accordance with another aspect of the invention, the two platens 50 and 51 are moved in a unique manner to cause the punch 31, the die 35 and the blades 37 and 38 to track the continuously advancing strip 22 and, at the same time, to cause the punch 31 and the blade 37 to shift laterally relative to the die 35 and the blade 38 for the purpose of cutting the strip. This aspect of the invention is particularly characterized by the fact that the cutting is carried out at high speeds and with a positive action.

More specifically, the two platens 50 and 51 are connected together in such a manner as to cause the platens to move in unison in a direction longitudinally of the strip 22 while permitting the front platen 50 to move laterally relative to the rear platen 51 in a direction laterally of the strip. For this purpose, two upper guide rods 60 (FIGS. 7 and 8) and one lower guide rod 61 are secured rigidly to the front platen 50 and are telescoped slidably into two upper guide bushings 62 and one lower guide bushing 63 which are secured to the rear platen 51. Thus, the rods and bushings permit the front platen to move laterally relative to the rear platen while at the same time coupling the platens together for longitudinal movement in unison.

Figure 9:
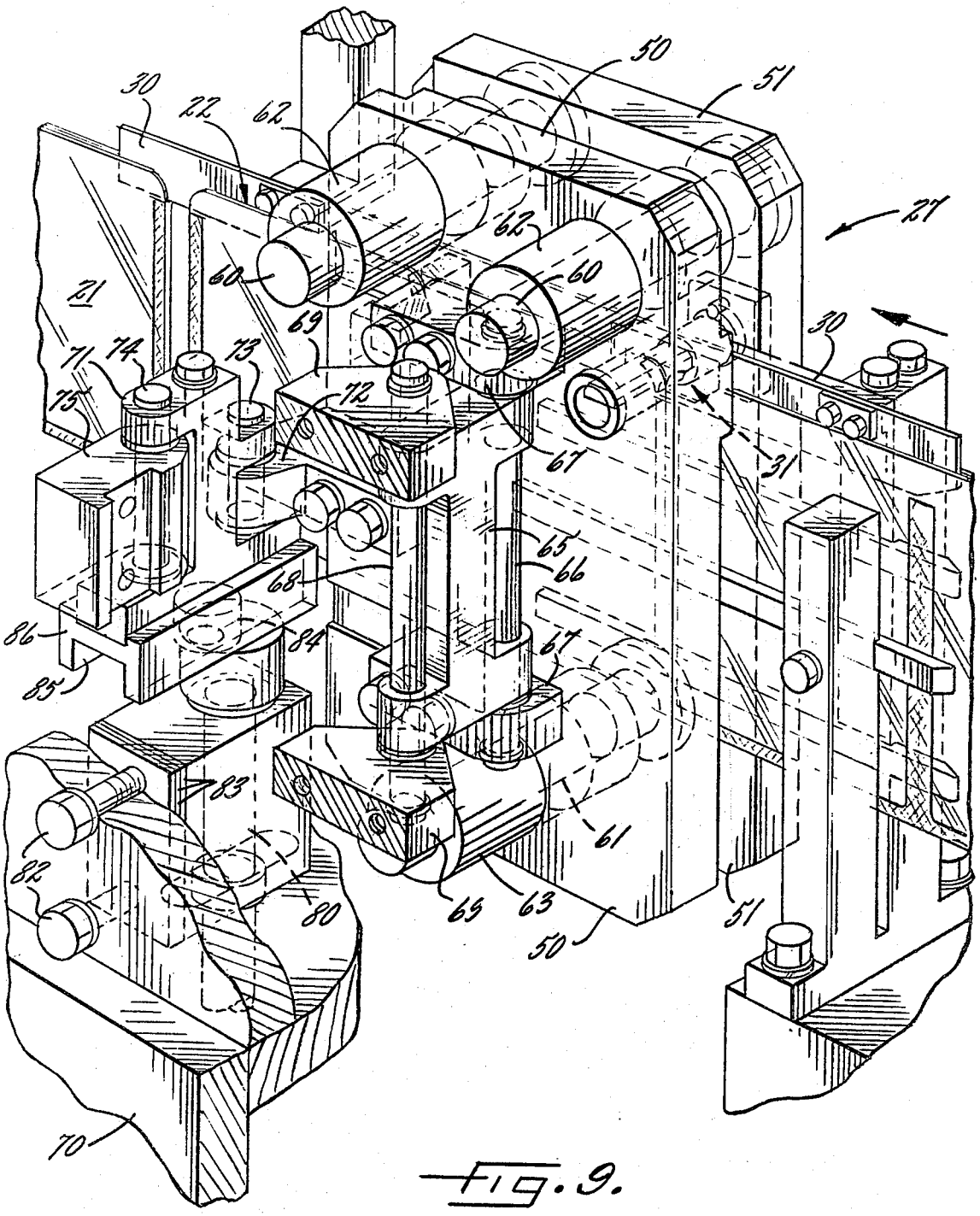
FIG. 9 is a fragmentary perspective view showing the rear side of the cutting mechanism.

A parallelogram linkage is used to mount the platens 50 and 51 for longitudinal movement. Herein, the linkage includes an upstream link 65 (FIGS. 5, 7 and 9) which is generally I-shaped in elevation. A front pin 66 extends through the link 65 and also extends pivotally through upper and lower brackets 67 on the rear side of the rear platen 51. A rear pin 68 also extends through the link 65 and is pivotally received by upper and lower mounting ears 69. The ears are secured rigidly to the rear side of a stationary, box-like frame 70 which is located in the cutting station 27.

Figure 6:
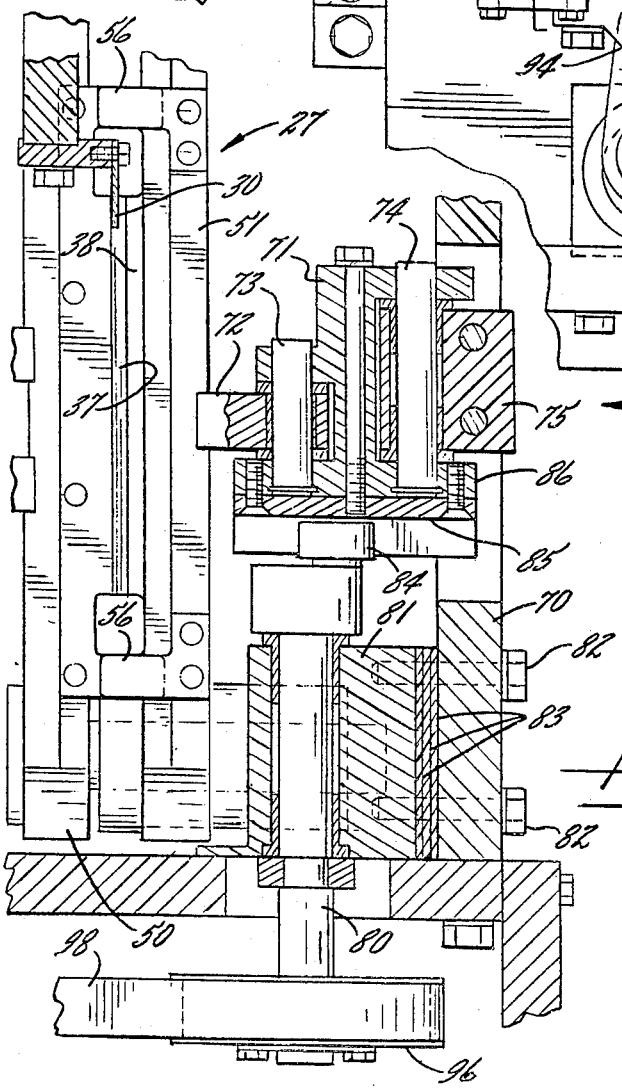
FIGS. 6 and 7 are fragmentary cross-sections taken substantially along the lines 6—6 and 7—7, respectively, of FIG. 5.

The parallelogram linkage further includes a downstream link 71 (FIGS. 5, 6 and 9) which also is generally I-shaped in elevation. An ear 72 projects rearwardly from the rear platen 51 and is pivotally connected to the front of the link 71 by a pin 73. A pin 74 pivotally connects the rear of the link 71 to an ear 75 which projects forwardly from the rear side of the frame 70.

By virtue of the parallelogram linkage defined by the links 65 and 71 and the pins 66, 68, 73 and 74, the rear platen 51 is capable of moving back and forth along the strip 22 in a virtually straight line. Because of the guide rods 60 and 61 and the bushings 62 and 63, the front platen 50 is moved back and forth along the strip with the rear platen 51. Thus, the punch 31, the die 35 and the blades 37 and 38 are capable of traveling in the same direction as the strip and may move into registry with and momentarily track the side seals 25 preparatory to cutting through the strip. The cutting elements then may be returned in an upstream direction to pick up the next pair of side seals. As the rear platen 51 moves along the strip, the parallelogram linkage causes the platen to move in a gradual arc but, as will be explained subsequently, the arc is so gradual and its high point relative to the strip is so located that there is no detrimental effect on the cutting action.

To move the platen 51 back and forth along the strip 22, a crank 80 (FIGS. 6 and 9) is rotatably journaled in a mounting block 81 which is secured to the frame 70 by screws 82, there being a stack of shims 83 between the block and the frame. An eccentric 84 is rotatably mounted on the upper end of the crank and is received within a laterally extending slot 85 which is formed in the lower side of a block-like member 86. The latter is secured rigidly to the lower side of the link 71.

When the crank 80 is rotated, the eccentric 84 orbits around the axis of the crank and moves laterally back and forth in the slot 85. Because of the slot, the lateral component of motion of the eccentric is isolated from the rear platen 51 and thus the eccentric does not impart any lateral motion to the platen. The eccentric does, however, bear against the side walls of the slot and hence the longitudinal component of motion of the eccentric is transmitted to the platen 51 and serves to move the platen back and forth along the strip 22.

Back and forth movement is imparted to the front platen 50 by a crank 90 (FIGS. 7 and 8) which is rotatably journaled by a bearing housing 91 secured to the front side of the frame 70. An eccentric 92 projects upwardly from the upper end of the crank 90 and is pivotally connected to the forward end of a link 93. The rear end of the link is received on a pivot pin 94 which is supported by two brackets 95 projecting forwardly from the front side of the front platen 50.

When the crank 90 is rotated, the lateral component of motion of the eccentric 92 is transmitted to the front platen 50 by the link 93 and causes the front platen to shift toward and away from the strip 22. Thus, the punch 31 and the blade 37 are first shifted toward the die 35 and the blade 38, respectively, to cut the strip 22 and then are retracted out of the path of the strip. The longitudinal component of force of the eccentric 92 also is transmitted to the front platen 50 by the link 93 but such component is small in comparison to the longitudinal force component imparted to the rear platen 51 by the eccentric 84. Thus, for all practical purposes, longitudinal movement of the platens is effected by means of the crank 80 and the eccentric 84.

The two eccentrics 84 and 92 are phased so that both are at a top dead center or 12 o'clock position at the same time. Also, the two cranks 80 and 90 are rotated in timed relation with one another and in timed relation with the advance of the strip 22. For this purpose, pulleys 96 and 97 (FIGS. 6 and 7) are secured to the lower ends of the cranks 80 and 90, respectively, and are connected to one another by an endless belt 98. The lower end of the crank 90 also is connected by a drive train 99 (FIG. 1) to the main cycle shaft 100 of the machine 20. The cycle shaft drives the feed rolls 26 and acts through the drive train 99 and the belt 98 to turn the cranks 80 and 90.

OPERATION

Figure 12B:
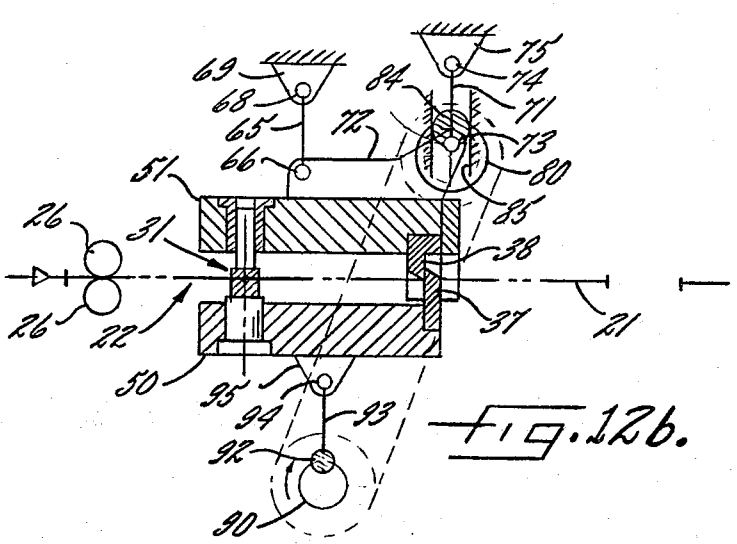
Figure 12D:
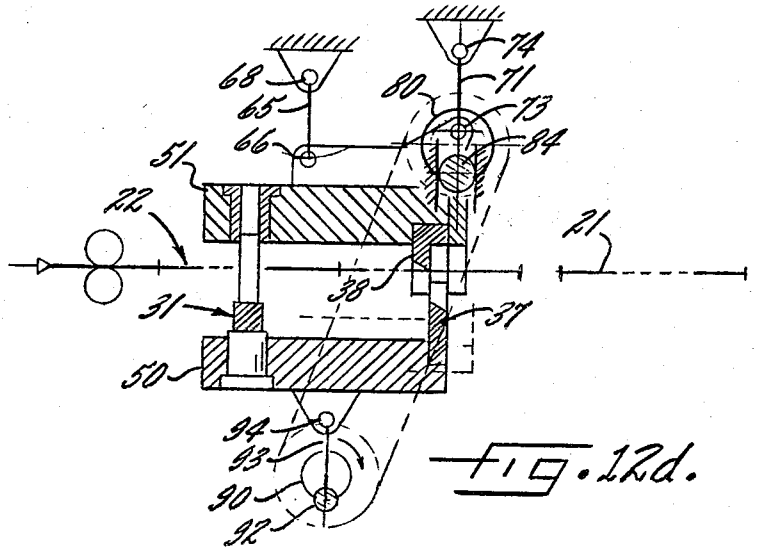
Figure 12A:
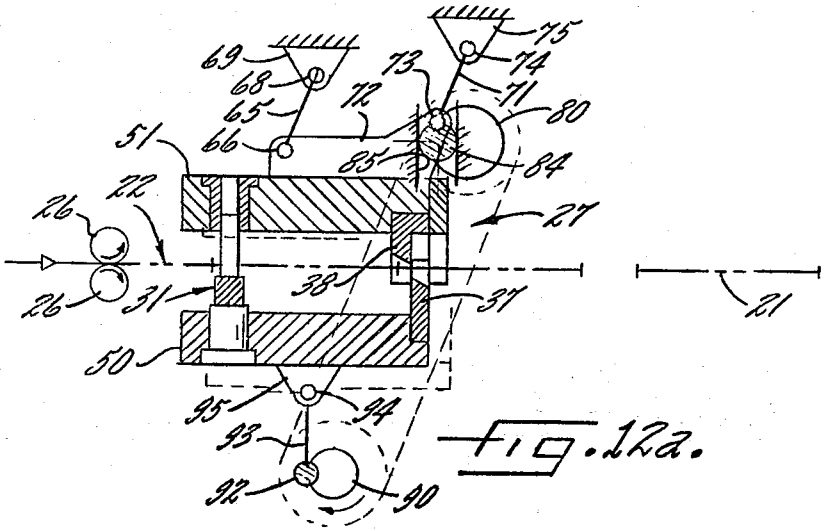

When the two eccentrics 84 and 92 are in the nine o'clock positions shown in FIG. 12*a*, the two platens 50 and 51 are in their furthest upstream positions relative to the strip 22. At this time, the eccentric 84 causes the links 65 and 71 to be turned in a clockwise direction about the pins 68 and 71, respectively, and, as a result of such turning, the blade 38 is spaced rearwardly from the strip 22 by a very slight distance. The eccentric 92 causes the blade 37 to be spaced forwardly of the strip and causes that blade to be disposed about midway between its fully open and fully closed positions.

As the eccentrics 84 and 92 turn clockwise from the nine o'clock positions (FIG. 12*a*) toward the twelve o'clock positions (FIG. 12*b*), the eccentric 84 acts against the slotted member 86 and causes the platens 50 and 51 to move downstream with the strip 22. At the same time, the eccentric 92 acts through the link 93 to shift the front platen 50 laterally toward the rear platen 51.

Upon approaching the twelve o'clock position, the eccentric 84 causes the links 65 and 71 to swing to positions perpendicular to the strip 22 so as to bring the die 35 and the rear blade 38 into close proximity to the strip. In addition, the eccentric 84 causes the instantaneous speed of the platens 50 and 51 to match the instanteous speed of strip 22. At this time, the eccentric 92 shifts the front platen 50 to its rearmost position to cause the punch 31 and the front blade 37 to close upon the die 35 and the rear blade 38, respectively. The leading pouch 21 thus is severed from the strip 22 by the blades 37 and 38 and, at the same time, the punch 31 and the die 35 form the notch 36 adjacent the trailing end of the next pouch.

Figure 12C:
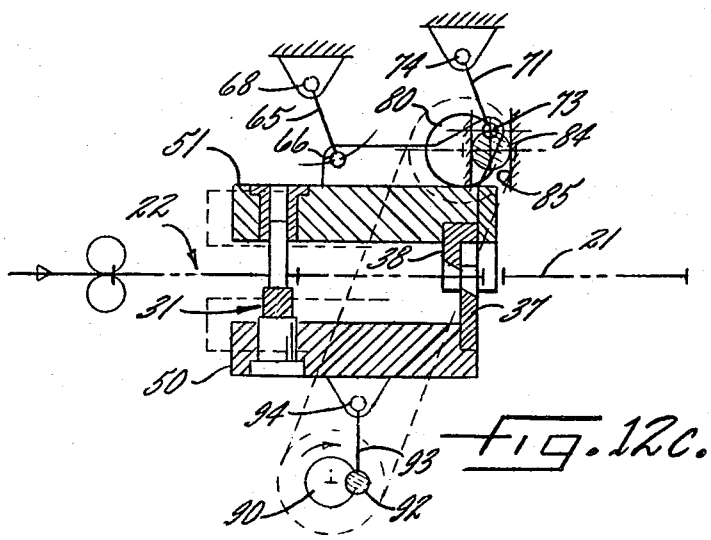

As the eccentrics 84 and 92 turn from the twelve o'clock positions (FIG. 12*b*) to the three o'clock positions (FIG. 12*c*), the eccentric 84 continues to move the platens 50 and 51 in a downstream direction. The eccentric 92, however, quickly retracts the front platen 50 away from the rear platen 51 to separate the punch 31 and the front blade 37 from the die 35 and the rear blade 38, respectively, and thereby prevent the punch 31 and the blade 37 from obstructing the advance of the strip. The links 65 and 71 also swing counterclockwise about the pins 68 and 74 to pull the die 35 and the blade 38 a slight distance away from the strip.

The eccentrics 84 and 92 then turn to the six o'clock positions (FIG. 12*d*) and, in so turning, the eccentric 92 continues to retract the front platen 50 away from the rear platen 51 while the eccentric 84 starts moving the platens in an upstream direction preparatory to the next cutting cycle. Upstream movement of the platens continues as the eccentrics turn from the six o'clock positions (FIG. 12*d*) to the nine o'clock positions (FIG. 12*a*) and, during such turning, the eccentric 92 starts moving the platen 50 inwardly toward the platen 51 preparatory to the platens again moving downstream when the eccentrics pass the nine o'clock position.

By virtue of the longitudinal and lateral motions being produced by the separate eccentrics 84 and 92, respectively, the actual cutting stroke occurs very fast and thus the time during which the speed of the platens 50 and 51 must match the speed of the strip 22 is very short. As a result, the platens can be cycled at very high speeds while still effecting clean and positive cutting of the strip. The present machine 20 is capable of handling pouches at rates as high as 250 pouches per minute.

The eccentric 84 enables the longitudinal stroke of the platens 50 and 51 to be easily adjusted if the machine 20 is changed over to run pouches of different widths. By taking out the screws 82 (FIG. 6) and adding or removing shims 83 between the block 81 and the frame 70, the lateral position of the crank 80 may be adjusted to change the lateral position of the eccentric 84 in the slotted member 86. This changes the effective length of the lever arm through which the eccentric 84 acts and causes the eccentric to move the platens 50 and 51 with a shorter stroke if the eccentric is adjusted toward the strip 22 and with a longer stroke if the eccentric is adjusted away from the strip.

I claim:

1. A packaging machine having means for advancing a strip of interconnected, open-ended pouches edgewise along a predetermined path with the open ends of the pouches facing upwardly, said strip being defined by a pair of face-to-face panels made of flexible material and sealed together by longitudinally spaced and vertically extending heat seals which terminate short of the upper edges of the panels, a substantially vertical splitter bar overlying said path and projecting downwardly between said panels to hold the upper edge portions of said panels separated from one another, said splitter bar having an opening formed therethrough, said opening having a lower wall located between the upper edges of said panels and the lower edge of said bar, a first cutter movable laterally within said opening and periodically operable to cut through the upper edge portions of said panels at longitudinal positions corresponding to the longitudinal positions of said heat seals, a downwardly opening notch formed through the lower edge portion of said bar downstream of said opening, said notch having an upper wall located below the upper edges of said panels, and a second cutter located downstream of said first cutter and periodically operable to cut through said heat seals thereby to separate successive leading pouches from said strip, said second cutter having an upper end which extends upwardly at least to the level of the lower end of said first cutter, which terminates short of the upper wall of said notch and which moves laterally within said notch during operation of said second cutter.

2. A packaging machine having means for continuously advancing a strip of interconnected, upright pouches edgewise along a predetermined path, mechanism for periodically severing successive pouches from the leading end portion of the strip, said mechanism comprising first and second carriages disposed on opposite sides of said strip, first and second coacting cutters mounted on said first and second carriages, respectively, means interconnecting said carriages for movement in unison longitudinally of said strip and permitting said first carriage to move laterally toward and away from said second carriage, means connected to and acting on said first carriage for moving the latter laterally toward and away from said second carriage, means connected to and acting on said second carriage for moving said carriages longitudinally of said strip, first in one direction and then the other, in timed relation with the lateral movement of said first carriage, said last-mentioned means comprising a power-rotated crank which, when rotated, produces components of motion both laterally and longitudinally of said strip, means including a member connecting said crank to said second carriage and operable to transmit to the second carriage the longitudinal component of motion produced by said crank and operable to isolate from the second carriage the lateral component of motion produced by said crank, said member having a laterally extending slot, and said crank having an eccentric disposed in said slot so as to move back and forth within said slot when said crank is rotated.

3. A packaging machine as defined in claim 2 further including third and fourth coacting cutters mounted on said first and second carriages, respectively, and spaced longitudinally of said strip from said first and second cutters by a distance equal to the width of one of said pouches.

4. A packaging machine as defined in claim 2 in which said means which are connected to and act on said first carriage comprise a second power-rotated crank which, when rotated, produces components of motion both laterally and longitudinally of said strip, and means connecting said second crank to said first carriage and operable to transmit both components of motion of said second crank to said first carriage.

5. A packaging machine as defined in claim 4 in which said last-mentioned means comprises a link pivotally connected to said second crank and to said first carriage.

6. A packaging machine as defined in claim 2 further including means enabling said crank to be adjusted laterally of said strip so as to permit the position of said eccentric within said slot to be changed.

7. A packaging machine as defined in claim 2 further including a pivoted parallelogram linkage supporting said second carriage.

8. A packaging machine having means for continuously advancing a strip of interconnected, upright pouches edgewise along a predetermined path, mechanism for periodically severing successive pouches from the leading end portion of the strip, said mechanism comprising first and second carriages disposed on opposite sides of said strip, first and second coacting cutters mounted on said first and second carriages, respectively, means interconnecting said carriages for movement in unison longitudinally of said strip and permitting said first carriage to move laterally toward and away from said second carriage, a pivoted parallelogram linkage supporting said second carriage, a first rotatable crank, a link connected between said first crank and said first carriage and acting to move said first carriage laterally of said strip when said crank is rotated, a second rotatable crank, a slotted member connecting said second crank to said second carriage and acting to move said second carriage longitudinally of said strip when said second crank is rotated, and means for rotating said cranks in timed relation with one another.

9. A packaging machine as defined in claim 8 in which said second crank includes an eccentric movable back and forth in said slotted member, and means for enabling said second crank to be adjusted laterally of said strip so as to permit the position of said eccentric within said slotted member to be changed.

* * * * *